United States Patent [19]

Samuels

[11] Patent Number: 5,043,108

[45] Date of Patent: Aug. 27, 1991

[54] PROCESS FOR PREPARING POLYETHYLENE PLEXIFILAMENTARY FILM-FIBRIL STRANDS

[75] Inventor: Sam L. Samuels, Claymont, Del.

[73] Assignee: E. I. Du Pont de Nemours and Company, Wilmington, Del.

[21] Appl. No.: 397,177

[22] Filed: Aug. 22, 1989

[51] Int. Cl.[5] ..... D01D 5/11

[52] U.S. Cl. ..... 264/13; 264/205; 264/211; 264/211.14

[58] Field of Search ..... 264/205, 53, 13, 211, 264/140, 517, 518

[56] References Cited

U.S. PATENT DOCUMENTS

| | | | |
|---|---|---|---|
| 3,081,519 | 3/1963 | Blades et al. | 28/81 |
| 3,227,794 | 1/1966 | Anderson et al. | 264/205 |
| 4,054,625 | 10/1977 | Kozlowski | 264/13 |

OTHER PUBLICATIONS

P. S. Zurer, "Search Intensifies for Alternatives to Ozone-Depleting Halocarbons", *Chemical & Engineering News,* pp. 17–20 (Feb. 8, 1988).

*Primary Examiner*—Hubert C. Lorin

[57] ABSTRACT

An improved process for flash-spinning polyethylene plexifilamentary film-fibril strands is provided. The strand is flash-spun from a non-chlorofluorocarbon mixture of polyethylene, an organic solvent and water.

2 Claims, No Drawings

PROCESS FOR PREPARING POLYETHYLENE PLEXIFILAMENTARY FILM-FIBRIL STRANDS

BACKGROUND OF THE INVENTION

1. Field of the Invention

This invention relates to a process for preparing polyethylene plexifilamentary film-fibril strands. More particularly, the invention concerns an improved process in which the strand is flash-spun from mixtures of polyethylene, an organic solvent and water.

2. Description of the Prior Art

Blades and White, U.S. Pat. No. 3,081,519 describes a flash-spinning process for producing plexifilamentary film-fibril strands from fiber-forming polymers. A solution of the polymer in a liquid, which is a non-solvent for the polymer at or below its normal boiling point, is extruded at a temperature above the normal boiling point of the liquid and at autogenous or higher pressure into a medium of lower temperature and substantially lower pressure. This flash spinning causes the liquid to vaporize and thereby cool the plexifilamentary film-fibril strand that forms from the polymer. Preferred polymers include crystalline polyhydrocarbons such as polyethylene and polypropylene.

According to U.S Pat. No. 3,081,519 the following liquids are useful in the flash-spinning process: aromatic hydrocarbons such as benzene, toluene, etc.; aliphatic hydrocarbons such as butane, pentane, hexane, heptane, octane, and their isomers and homologs; alicyclic hydrocarbons such as cyclohexane; unsaturated hydrocarbons; halogenated hydrocarbons such as methylene chloride, carbon tetrachloride, chloroform, ethyl chloride, methyl chloride; alcohols; esters; ethers; ketones; nitriles; amides; fluorocarbons; sulfur dioxide; carbon disulfide; nitromethane; water; and mixtures of the above liquids. The patent further states that the flash-spinning solution additionally may contain a dissolved gas, such as nitrogen, carbon dioxide, helium, hydrogen, methane, propane, butane, ethylene, propylene, butene, etc. Preferred for improving plexifilament fibrillation are the less soluble gases, i.e., those that dissolve to a less than 7% concentration in the polymer solution under the spinning conditions.

Flash spinning a polyolefin discrete fiber from a polymer dissolved in a solvent with water added in quantities sufficient to form an emulsion or inverse emulsion is known. For example, Kozlowski U.S. Pat. No. 4,054,625 teaches a process of manufacturing discrete fibers from water and a solution of polymer in an organic solvent and water. Critical to the process of Kozlowski, is that the water is present in an amount such that it constitutes a discontinuous phase dispersed as discrete droplets throughout the polymer solution. This "inverse emulsion" is then flash spun to form discrete fibers. Water concentrations of 40 to 50%, far exceeding the solubility of water in the organic solvent, are preferred for the process even though more care in mixing the solution must be exercised to ensure that the water is the discontinuous phase.

Commercial spunbonded products made from polyethylene plexifilamentary film-fibril strands have been successfully produced with the polyethylene being flash-spun from trichlorofluoromethane. Although trichlorofluoromethane has been used extensively for this purpose, the escape of such a halocarbon into the atmosphere has been implicated as a source of depletion of the earth's ozone. A general discussion of the ozone-depletion problem is presented, for example, by P. S. Zurer, "Search Intensifies for Alternatives to Ozone-Depleting Halocarbons", *Chemical & Engineering News*, pages 17–20 (Feb. 8, 1988).

This invention provides an improved process for preparing polyethylene plexifilamentary film-fibril strands. The strand is spun from a non-chlorofluorocarbon mixture of polyethylene, an organic solvent and water.

SUMMARY OF THE INVENTION

There is provided by this invention an improved process for flash-spinning polyethylene plexifilamentary film-fibril strands, wherein a spin mixture is formed comprising an organic solvent, polyethylene and water which is then flash-spun at a pressure that is greater than the autogenous pressure of the spin mixture into a region of substantially lower temperature and pressure, the improvement comprising, in combination, the water amounting to from 0.5 percent by weight of the organic solvent to an amount equal to the saturation limit of water in the solvent and the polyethylene amounting to from 5 to 25 percent by weight of the polyethylene and the organic solvent, the mixing and the flash-spinning being performed at a temperature in the range of 100° to 250° C.

DETAILED DESCRIPTION OF PREFERRED EMBODIMENTS

The term "polyethylene" is intended to embrace not only homopolymers of ethylene, but also copolymers wherein at least 85% of the recurring units are ethylene units. The preferred polyethylene is a homopolymeric linear polyethylene which has an upper limit of melting range of about 130 to 135° C., a density in the range of 0.94 to 0.98 g/cm$^3$ and a melt index (as defined by ASTM D-1238-57T, Condition E) of 0.1 to 6.0.

The term "plexifilamentary film-fibril strands of polyethylene", as used herein, means a strand which is characterized as a three-dimensional integral network of a multitude of thin, ribbon-like, film-fibril elements of random length and of less than about 4 microns average thickness, generally coextensively aligned with the longitudinal axis of the strand. The film-fibril elements intermittently unite and separate at irregular intervals in various places throughout the length, width and thickness of the strand to form the three-dimensional network. Such strands are described in further detail by Blades and White, U.S. Pat. No. 3,081,519 and by Anderson and Romano, U.S. Pat. No. 3,227,794.

The term "organic solvent" as used herein refers to any substituted or unsubstituted aliphatic, aromatic or cyclic hydrocarbon which is a solvent for polyethylene under the conditions of this invention. Examples of suitable solvents include cyclohexane, hexane, heptane, octane, xylene, toluene, benzene, methylcyclohexane and methylcyclopentane. Conveniently, cyclohexane is the preferred solvent.

The term "spin mixture" as used herein refers to a homogeneous solution of organic solvent, polyethylene and water, wherein the water amounts to from 0.5 weight percent of the organic solvent to an amount equal to the saturation limit of water in the solvent.

The present invention provides an improvement in the known process for producing polyethylene plexifilamentary film-fibril strands by flash-spinning polyethylene from a non-chlorofluorocarbon mixture of polyethylene, an organic solvent and water. The process of the present invention requires the flash-spinning to be performed with a spin mixture comprising; water amounting to from 0.5 weight percent of the solvent to an amount equal to the saturation limit of water in the solvent; and polyethylene amounting to from 5 to 25 percent by weight of polymer and solvent.

Critical to the formation of the highly fibrillated strands, i.e. strands of high surface area, of the invention is the addition of water under the conditions of this invention. The water dissolved in the solvent of the spin mixture of this invention, has the effect of decreasing the solvating power of the organic solvent which results in increased surface area of the spun plexifilament. Additional amounts of water, i.e. amounts exceeding the solubility limit of the water in the organic solvent, can require special mixing and result in the formation of inverse emulsions or emulsions and can lead to the formation of discrete fibers as taught by Kozlowski. No water, or water amounting to less than 0.5 weight percent of the organic solvent result in a poorly fibrillated strands.

The spin mixture comprises polyethylene, an organic solvent and water. However, conventional flash spinning additives can be incorporated into the solution. Examples of such additives are ultraviolet-light stabilizers, antioxidants, fillers, dyes, and the like.

The order in which the polyethylene, organic solvent and water are mixed is not critical. Conveniently, the process of this invention can be carried out using the output of an ethylene polymerizing process. That is, water can be added to the polyethylene dissolved in the organic solvent used to polymerize ethylene. The advantage in a continuous process from the ethylene polymerizer is that this circumvents the costly procedure of isolating the polyethylene and later re-dissolving it in an organic solvent and water.

The mixing and the flash-spinning, i.e. passing the mixture through the orifice, can be performed at about the same temperature. The temperature is in the range from 100 to 250° C. The upper limit on temperature is determined to avoid polymer decomposition or the production of sintered plexifilaments. The lower limit is to allow significant solubility of the water and essentially complete vaporization of the solvent during spinning.

The pressure during the mixing and spinning can be the same, but often the pressure is reduced somewhat after formation of the spin mixture and immediately before flash-spinning. Typically, mixing and spinning pressures are in the range of 800 to 5,000 psi, and usually 1,000 to 2,500 psi.

EXAMPLES

The invention is illustrated in the Examples which follow with batch processes in equipment of relatively small size. Such batch processes can be scaled-up and converted to continuous flash-spinning processes that can be performed, for example, in the type of equipment disclosed by Anderson and Romano, U.S. Pat. No. 3,227,794.

TEST METHODS

The fibrillation level of the plexifilamentary film-fibril strands produced in the examples were rated subjectively. A rating of "5" indicates that the strand had better fibrillation than is usually achieved in the commercial production of spunbonded sheet made from such flash-spun polyethylene strands. A rating of "4" indicates that the product was as good as commercially flash-spun strands. A rating of "3" indicates that the strands were not quite as good as the commercially flash-spun strands. A "2" indicates a very poorly fibrillated, inadequate strand. A "1" indicates no strand formation. A rating of "3" is the minimum considered satisfactory for use in the process of the present invention.

The surface area of the plexifilamentary film-fibril strand product is another measure of the degree and fineness of fibrillation of the flash-spun product. Surface area is measured by the BET nitrogen absorption method of S. Brunauer, P.H. Emmett and E. Teller, J. Am. Chem Soc., V. 60 p 309–319 (1938) and is reported as $m^2/g$.

EQUIPMENT/METHODOLOGY

For the Examples 1 to 5 and Control A of Table I, high density linear polyethylene of 1.0 Melt Index was employed. The apparatus used consists of two high pressure cylindrical chambers, each equipped with a piston which is adapted to apply pressure to the contents of the vessel. The cylinders have an inside diameter of 1.0 inch and each has an internal capacity of 30 cubic centimeters. The cylinders are connected to each other at one end through a 3/32 inch diameter channel and a mixing chamber containing a series of fine mesh screens used as a static mixer. Mixing is accomplished by forcing the contents of the vessel back and forth between the two cylinders through the static mixer. A spinneret assembly with a quick-acting means for opening the orifice is then attached to the channel through a tee leading to the 0.030 inch diameter × 0.020 inch length orifice. During mixing, the pistons are driven by high pressure water supplied by a hydraulic system. During the spin, high pressure nitrogen is used to drive the pistons. A pressure transducer is used to measure the pressure in the line to the orifice.

In operation, the apparatus is charged with the ingredients (polyethylene powder, cyclohexane, and for Examples 1 to 5, water) and high pressure water (1000 psi) is introduced to drive the piston to compress the charge. The contents then are heated to 140° C. and held at the temperature for about an hour or longer during which time a differential pressure of about 200 psia is alternatively established between the two cylinders to repeatedly force the contents through the mixing channel from one cylinder to the other to provide mixing and put the polymer into solution. The solution temperature is then raised to the final spin temperature, and held there for about 15 minutes to equilibrate the temperature and allow the water to dissolve. Mixing is continued throughout this period. Finally, the spinneret orifice is opened, and the resultant flash-spun product is collected. The pressure inside the channel to the spinneret orifice is recorded during spinning using a computer and is entered as spin pressure in Table I. Under the conditions of Examples 1 to 5, the solubility limit of water in the organic solvent, cyclohexane, is 6%.

TABLE I

| | EXAMPLE | | |
|---|---|---|---|
| | A | 1 | 2 |
| POLYMER CONC (WGT %) | 15 | 15 | 15 |
| WATER (WGT %) | 0 | 2 | 3 |

TABLE I-continued

| | EXAMPLE | | |
|---|---|---|---|
| MIX T (°C.) | 140 | 140 | 140 |
| MIX P (PSIG) | 1000 | 1000 | 1000 |
| SPIN T (°C.) | 223 | 224 | 223 |
| SPIN P (PSIG) | ~1280 | ~1315 | ~1360 |
| SPIN ORIFICE (MILS) | 30 × 20 | 30 × 20 | 30 × 20 |
| FIBRILLATION LEVEL | 2 | 3 | 4 |
| SA ($M^2$/GM) | 4.6 | 11.8 | 27.0 |
| | 3 | 4 | 5 |
| POLYMER CONC (WGT %) | 15 | 15 | 15 |
| WATER (WGT %) | 4 | 5 | 6 |
| MIX T (C) | 140 | 140 | 140 |
| MIX P (PSIG) | 1000 | 1000 | 1000 |
| SPIN T (C) | 224 | 221 | ~223 |
| SPIN P (PSIG) | ~1360 | ~1330 | ~1335 |
| SPIN ORIFICE (MILS) | 30 × 20 | 30 × 20 | 30 × 20 |
| FIB LEVEL | 4 | 4 | 4 |

TABLE I-continued

| | EXAMPLE | | |
|---|---|---|---|
| SA ($M^2$/GM) | 35.4 | 29.0 | 24.0 |

Wgt % polymer based on cyclohexane and polymer weight
Wgt % water based on cyclohexane weight only

I claim:

1. An improved process for flash-spinning polyethylene plexifilamentary film-fibril strands, wherein a spin mixture is formed comprising an organic solvent, polyethylene and water which is then flash-spun at a pressure that is greater than the autogenous pressure of the spin mixture into a region of substantially lower temperature and pressure, the improvement comprising, in combination, the water amounting to from about 0.5 percent by weight of the organic solvent to an amount equal to the saturation limit of water in the solvent such that a discontinuous phase is not formed and the polyethylene amounting to from 5 to 25 percent by weight of the polyethylene and the organic solvent, the mixing and the flash-spinning being performed at a temperature in the range of 100° to 250° C.

2. The process of claim 1 wherein the organic solvent is cyclohexane.

* * * * *